US011431135B2

(12) United States Patent
Wu et al.

(10) Patent No.: US 11,431,135 B2
(45) Date of Patent: Aug. 30, 2022

(54) ELECTRICAL CONNECTOR STRUCTURE WITH THREE SETS OF TERMINALS AND A GROUND CONNECTING STRUCTURE

(71) Applicant: SPEED TECH CORP., Taoyuan (TW)

(72) Inventors: Chu-Cheng Wu, Taoyuan (TW); I-Ting Hsieh, Taoyuan (TW); Cheng-Hsiang Hsueh, Taoyuan (TW); Kuo-Hua Huang, Taoyuan (TW); Hua-Chun Chang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 17/085,852

(22) Filed: Oct. 30, 2020

(65) Prior Publication Data

US 2021/0135405 A1 May 6, 2021

(30) Foreign Application Priority Data

Oct. 31, 2019 (TW) ..... 108139566

(51) Int. Cl.
*H01R 13/6597* (2011.01)
*H01R 12/73* (2011.01)
(Continued)

(52) U.S. Cl.
CPC ..... *H01R 13/6597* (2013.01); *H01R 12/724* (2013.01); *H01R 12/727* (2013.01); *H01R 12/73* (2013.01); *H01R 13/6581* (2013.01); *H01R 12/71* (2013.01); *H01R 13/422* (2013.01); *H01R 13/502* (2013.01); *H01R 13/648* (2013.01);
(Continued)

(58) Field of Classification Search
CPC ..... H01R 31/08; H01R 2201/06; H01R 13/6469; H01R 13/6467; H01R 13/6597; H01R 12/724; H01R 12/727; H01R 12/73; H01R 13/6581; H01R 13/502; H01R 13/6599; H01R 13/422; H01R 13/6471; H01R 13/6461; H01R 12/71; H01R 13/648
See application file for complete search history.

(56) References Cited

U.S. PATENT DOCUMENTS

2015/0188250 A1* 7/2015 Liu ..... H01R 13/504 439/86
2016/0148887 A1 5/2016 Yu
(Continued)

FOREIGN PATENT DOCUMENTS

CN 203850501 U 9/2014
CN 104701677 A 3/2015
(Continued)

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

An electrical connector structure includes an insulating housing, a first terminal set, a second terminal set, a third terminal set and at least one conductive member. The first, second and third terminal sets are disposed in the insulating housing. Each of the first and second terminal sets includes a plurality of signal terminals and at least one ground terminal. The conductive member is electrically connected to the ground terminals of the first and second terminal sets, and is not electrically connected to the third terminal set.

21 Claims, 19 Drawing Sheets

(51) Int. Cl.

| | |
|---|---|
| ***H01R 12/72*** | (2011.01) |
| ***H01R 13/6581*** | (2011.01) |
| *H01R 13/502* | (2006.01) |
| *H01R 13/6599* | (2011.01) |
| *H01R 13/422* | (2006.01) |
| *H01R 13/6467* | (2011.01) |
| *H01R 12/71* | (2011.01) |
| *H01R 13/648* | (2006.01) |
| *H01R 13/6471* | (2011.01) |
| *H01R 13/6469* | (2011.01) |
| *H01R 31/08* | (2006.01) |
| *H01R 13/6461* | (2011.01) |

(52) U.S. Cl.
CPC ..... *H01R 13/6461* (2013.01); *H01R 13/6467* (2013.01); *H01R 13/6469* (2013.01); *H01R 13/6471* (2013.01); *H01R 13/6599* (2013.01); *H01R 31/08* (2013.01); *H01R 2201/06* (2013.01)

(56) References Cited

U.S. PATENT DOCUMENTS

| | | | | |
|---|---|---|---|---|
| 2016/0308314 | A1* | 10/2016 | Yu ..... | H01R 13/6658 |
| 2018/0062323 | A1 | 3/2018 | Kirk et al. | |

FOREIGN PATENT DOCUMENTS

| | | | |
|---|---|---|---|
| CN | 204190038 | U | 3/2015 |
| CN | 104979717 | A | 10/2015 |
| CN | 105428860 | A | 3/2016 |
| CN | 105914532 | A | 8/2016 |
| CN | 107453064 | A | 12/2017 |
| CN | 107978886 | A | 5/2018 |
| CN | 208955231 | U | 6/2019 |
| CN | 110247261 | A | 9/2019 |
| TW | M534921 | U | 1/2017 |
| TW | M544138 | U | 6/2017 |
| TW | M563682 | U | 7/2018 |
| TW | 201911674 | A | 3/2019 |
| TW | I654803 | B | 3/2019 |

* cited by examiner

ELECTRICAL CONNECTOR STRUCTURE WITH THREE SETS OF TERMINALS AND A GROUND CONNECTING STRUCTURE

RELATED APPLICATIONS

This application claims priority to Taiwan Application Serial Number 108139566, filed Oct. 31, 2019, the disclosure of which is incorporated herein by reference in its entirety.

BACKGROUND

Technical Field

The present disclosure relates to an electrical connector structure.

Description of Related Art

Wired transmission between different electronic devices is mainly achieved through electrical connectors. In recent years, rapid progress has been made in science and technology, and the requirement for transmission bandwidth has increased correspondingly. To meet the increasingly higher demand for bandwidth, it is necessary to raise the frequency of the transmitted electronic signal. However, high frequency signals are susceptible to crosstalk (especially when the signal terminals are too close to each other).

SUMMARY

In view of the foregoing, one of the objects of the present disclosure is to provide an electrical connector structure that reduces crosstalk.

To achieve the objective stated above, in accordance with an embodiment of the present disclosure, an electrical connector structure includes an insulating housing, a first terminal set, a second terminal set, a third terminal set and at least one conductive member. The first, second and third terminal sets are disposed in the insulating housing. Each of the first and second terminal sets includes a plurality of signal terminals and at least one ground terminal. The conductive member is electrically connected to the ground terminals of the first and second terminal sets, and is not electrically connected to the third terminal set.

In one or more embodiments of the present disclosure, the at least one conductive member includes a first conductive member and a second conductive member. The first conductive member is electrically connected to the ground terminal of the first terminal set. The second conductive member is electrically connected to the ground terminal of the second terminal set.

In one or more embodiments of the present disclosure, the first conductive member and the second conductive member are disposed in or disposed on the insulating housing.

In one or more embodiments of the present disclosure, the insulating housing includes a plurality of containing slots. The first conductive member and the second conductive member are disposed in the containing slots.

In one or more embodiments of the present disclosure, the insulating housing has a plurality of protruding structures. The first conductive member is disposed on the protruding structures.

In one or more embodiments of the present disclosure, the first conductive member wraps around and contacts a section of the ground terminal of the first terminal set.

In one or more embodiments of the present disclosure, the second conductive member wraps around and contacts a section of the ground terminal of the second terminal set.

In one or more embodiments of the present disclosure, the electrical connector structure further includes an insulating member. The insulating member encapsulates the first conductive member and wraps around a section of each of the signal terminals of the first terminal set.

In one or more embodiments of the present disclosure, the first conductive member includes at least one conductive terminal and a conductive connecting structure. The conductive terminal is disposed between or on a side of the signal terminals of the first terminal set to serve as ground terminal of the first terminal set. The conductive connecting structure physically connects the at least one conductive terminal and is electrically connected to the ground terminal of the first terminal set.

In one or more embodiments of the present disclosure, the first conductive member includes two conductive terminals disposed on opposite sides of the first terminal set. The conductive connecting structure is interconnected between the two conductive terminals.

In one or more embodiments of the present disclosure, the first conductive member is a metallic member.

In one or more embodiments of the present disclosure, the electrical connector structure further includes an insulating member disposed in the insulating housing. The insulating member wraps around a section of the ground terminal of the first terminal set and a section of each of the signal terminals of the first terminal set. The first conductive member is electrically connected to the ground terminal of the first terminal set via the insulating member.

In one or more embodiments of the present disclosure, the electrical connector structure further includes a terminal spacer. The terminal spacer is disposed in the insulating housing and is located between the first terminal set and the second terminal set. The terminal spacer has a plurality of recesses configured to receive the ground terminal and the signal terminals of the first terminal set. The first conductive member is disposed on the terminal spacer.

In one or more embodiments of the present disclosure, the first conductive member is fused to the terminal spacer.

In one or more embodiments of the present disclosure, the second terminal set includes a plurality of ground terminals. The second conductive member includes a plurality of conductive components. Each of the conductive components is electrically connected to at least one of the ground terminals of the second terminal set.

In one or more embodiments of the present disclosure, the conductive member is disposed on a side of the terminal spacer facing the second terminal set. The conductive member is electrically connected to the ground terminal of the first terminal set via the terminal spacer interposed therebetween.

In one or more embodiments of the present disclosure, the conductive member is disposed on a side of the terminal spacer facing the second terminal set. One or more of the recesses corresponding to the ground terminal of the first terminal set each has an opening. The conductive member is electrically connected to the ground terminal of the first terminal set via the opening interposed therebetween.

In one or more embodiments of the present disclosure, the conductive member has a projection extending towards the ground terminal of the first terminal set or the ground terminal of the second terminal set.

In one or more embodiments of the present disclosure, the projection is spaced apart from the ground terminal by 0.01 mm to 0.3 mm.

In one or more embodiments of the present disclosure, the conductive member includes a conductive plastic member.

In one or more embodiments of the present disclosure, the insulating housing has a socket. The socket is configured to receive a pairing connector having a tongue.

In one or more embodiments of the present disclosure, the electrical connector structure is arranged to be substantially parallel to an external board. The first terminal set is located farther away from the external board than the second terminal set. A tip of the ground terminal of the first terminal set and tips of the signal terminals of the first terminal set are configured to be connected to the external board.

In one or more embodiments of the present disclosure, the electrical connector structure is arranged to be substantially perpendicular to an external board. The first terminal set and the second terminal set are of substantially equal distance to the external board.

In sum, the electrical connector structure of the present disclosure is equipped with at least one conductive member that is electrically connected to the first and the second terminal sets, and not electrically connected to the third terminal set. By this arrangement, crosstalk may be effectively reduced.

BRIEF DESCRIPTION OF THE DRAWINGS

To make the objectives, features, advantages, and embodiments of the present disclosure, including those mentioned above and others, more comprehensible, descriptions of the accompanying drawings are provided as follows.

DETAILED DESCRIPTION

Figure 1:
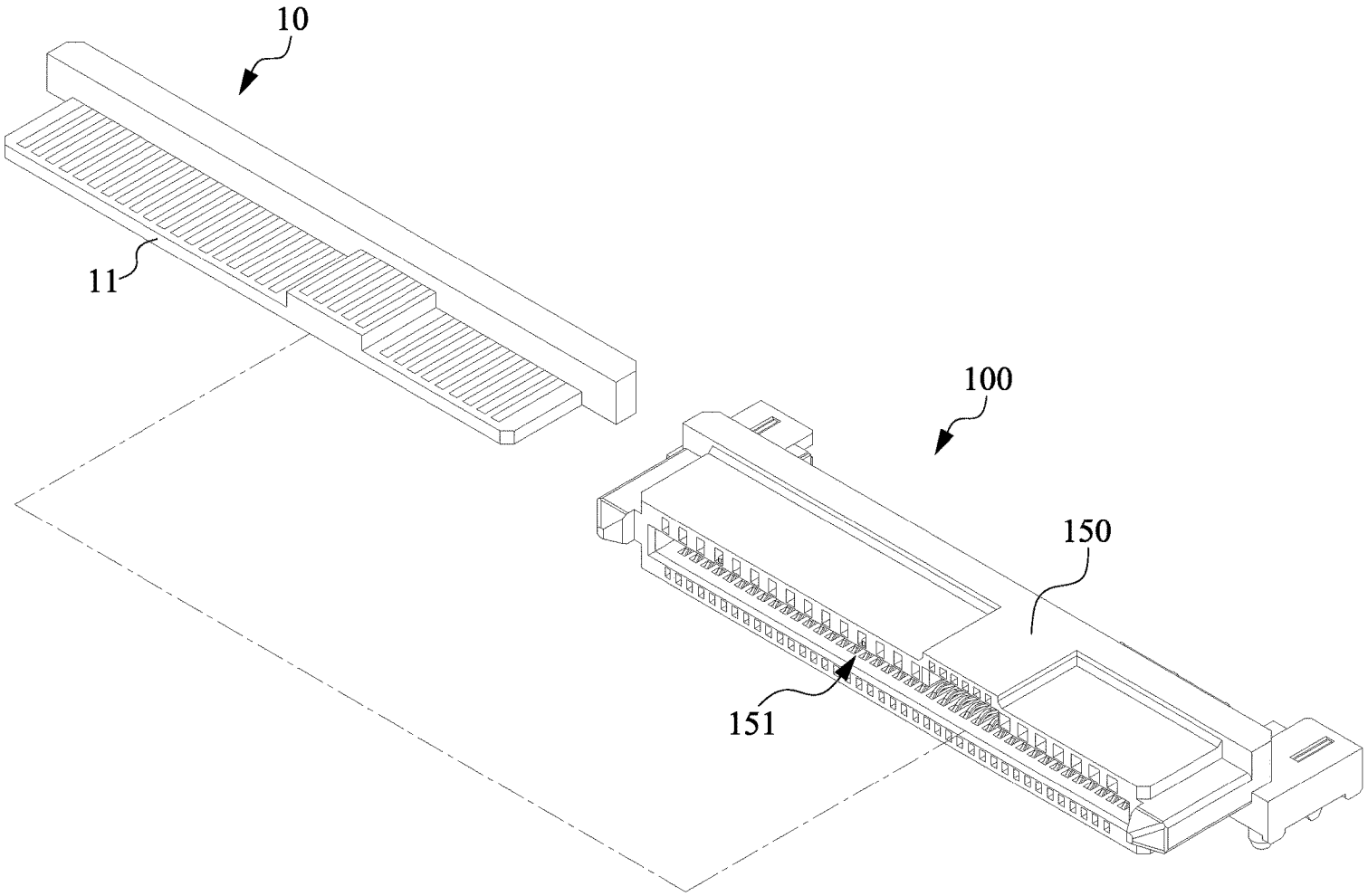
FIG. 1 illustrates an assembled view of an electrical connector structure in accordance with an embodiment of the present disclosure from a view angle.

For the sake of the completeness of the description of the present disclosure, reference is made to the accompanying drawings and the various embodiments described below. Various features in the drawings are not drawn to scale and are provided for illustration purposes only. To provide full understanding of the present disclosure, various practical details will be explained in the following descriptions. However, a person with an ordinary skill in relevant art should realize that the present disclosure can be implemented without one or more of the practical details. Therefore, the present disclosure is not to be limited by these details.

Figure 2:
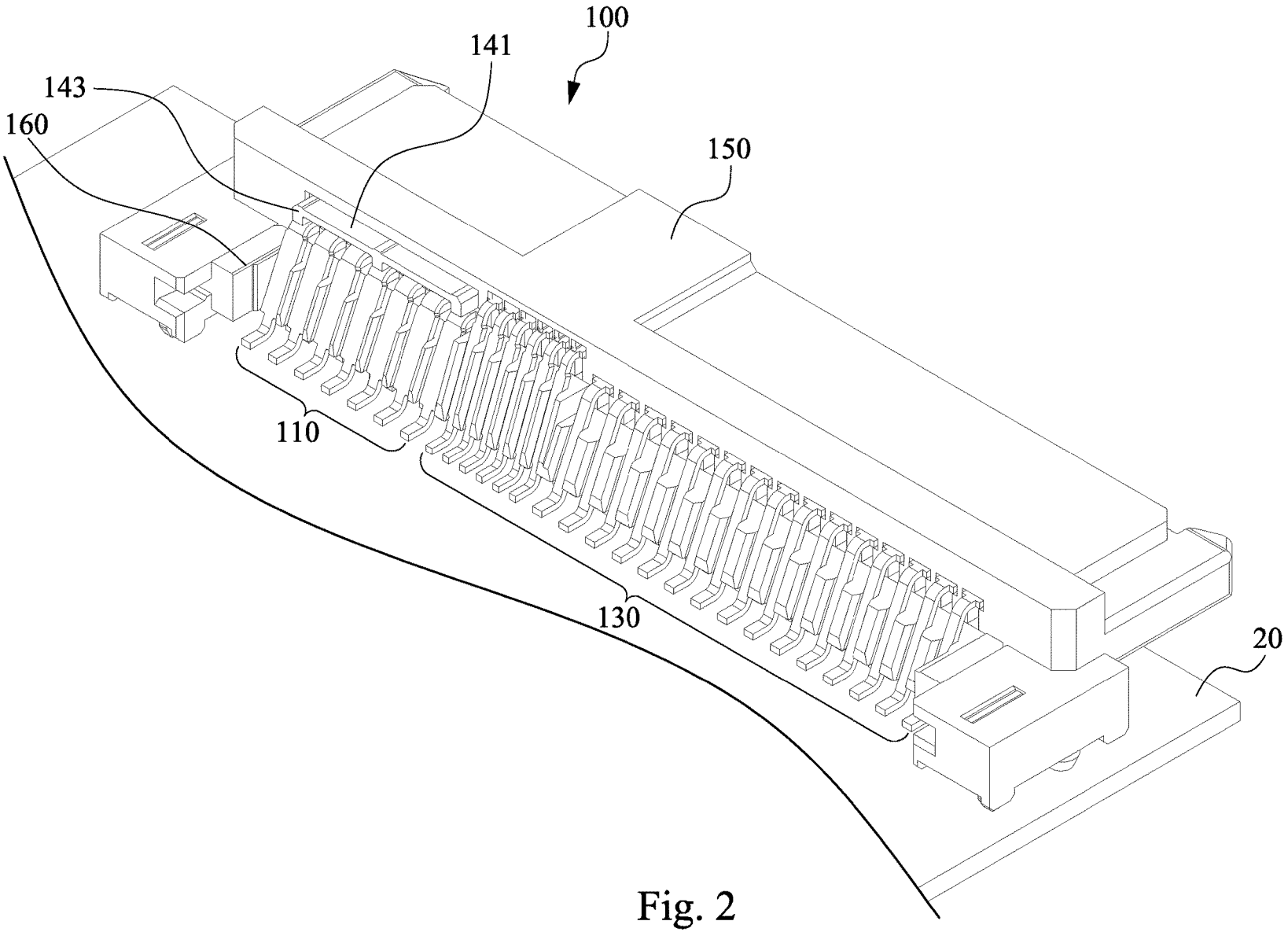
FIG. 2 illustrates an assembled view of the electrical connector structure shown in FIG. 1 from another view angle.
Figure 3:
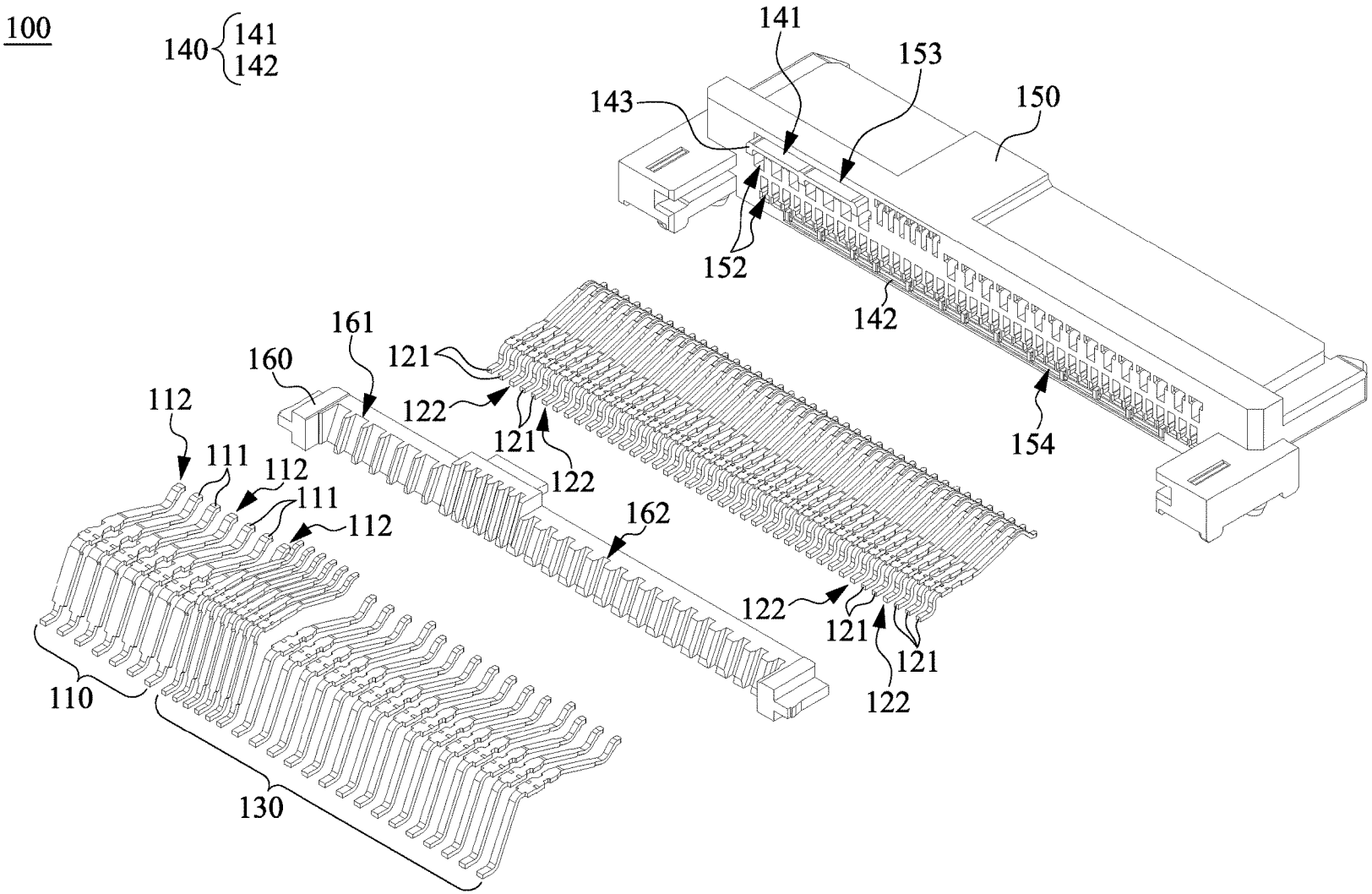
FIG. 3 illustrates an exploded view of the electrical connector structure shown in FIG. 2.

Reference is made to FIGS. 1-3. FIG. 1 illustrates an assembled view of an electrical connector structure 100 in accordance with an embodiment of the present disclosure from a view angle. FIG. 2 illustrates an assembled view of the electrical connector structure 100 shown in FIG. 1 from another view angle. FIG. 3 illustrates an exploded view of the electrical connector structure 100 shown in FIG. 2. The electrical connector structure 100 includes an insulating housing 150, a first terminal set 110, a second terminal set 120, a third terminal set 130 and a conductive member 140 (depicted in FIG. 3). The first terminal set 110, the second terminal set 120 and the third terminal set 130 are disposed in the insulating housing 150 and each include a plurality of terminals. Specifically, as shown in FIG. 1, the insulating housing 150 has a socket 151 on its front side. The socket 151 is configured to receive a pairing connector 10 having a tongue 11. As shown in FIG. 3, the insulating housing 150 further includes a plurality of through holes 152 in communication with the socket 151. The terminals of the first terminal set 110, the second terminal set 120 and the third terminal set 130 extend through the through hole 152 into the socket 151 to make electrical connection with the pairing connector 10.

As shown in FIG. 2, in some embodiments, the electrical connector structure 100 is a right angle connector. The electrical connector structure 100 is configured to be electrically connected to an external board 20 and is arranged to be substantially parallel to the external board 20. The first terminal set 110 is located farther away from the external board 20 than the second terminal set 120. The first terminal set 110 is configured to perform signal transmission and includes a plurality of signal terminals 111 and at least one ground terminal 112. Tips of the signal terminals 111 and the ground terminal 112 of the first terminal set 110 are configured to be connected to the external board 20. In some embodiments, the electrical connector structure 100 is a vertical connector. In such embodiments, the electrical connector structure 100 is configured to be electrically connected to the external board 20 and is arranged to be substantially perpendicular to the external board 20. In such embodiments, first terminal set 110 and the second terminal set 120 are of substantially equal distance to the external board 20. In some embodiments, the electrical connector structure 100 is an SFF-8639 connector.

As shown in FIGS. 2 and 3, the signal terminals 111 and the ground terminal 112 of the first terminal set 110 are arranged in an interleaved fashion. The second terminal set 120 faces the first terminal set 110 and includes a plurality of signal terminals 121 and at least one ground terminal 122 arranged in an interleaved fashion to perform signal transmission. The conductive member 140 is electrically connected to the ground terminal 112 of the first terminal set 110 and the ground terminal 122 of the second terminal set 120, and is not electrically connected to the third terminal set 130, thereby reducing crosstalk.

The conductive member 140 may include metallic member(s) or conductive plastic member(s). A conductive plastic member may be a plastic member doped with conductive material(s), or an electroplated plastic member. The conductive member 140 may establish electrical connection with the ground terminal 112/122 with or without physically contacting the ground terminal 112/122. In some embodiments, when the conductive member 140 is a conductive plastic member or when the conductive member 140 does not make physical contact with the ground terminals 112 and 122, the conductive member 140 and the ground terminals 112 and 122 may also be referred to as being electrically coupled. Electric coupling includes conductive coupling through electrically conductive medium and/or radiative coupling through space. In some embodiments, the conductive member 140 includes at least one projection 143 extending towards a corresponding ground terminal 112 or 122. In some embodiments, the projection 143 is not in contact with the corresponding ground terminal 112 or 122. In some embodiments, the projection 143 is spaced apart from the corresponding ground terminal 112 or 122 by 0.01 mm to 0.3 mm.

As shown in FIGS. 2 and 3, in the present embodiment, the conductive member 140 is arranged on an outer side of the first terminal set 110 and the second terminal set 120. Specifically, the conductive member 140 includes a first conductive member 141 and the second conductive member 142. The first conductive member 141 is located on a side of the first terminal set 110 away from the second terminal set 120, and is electrically connected to the ground terminal 112 of the first terminal set 110. The second conductive member 142 is located on a side of the second terminal set 120 away from the first terminal set 110, and is electrically connected to the ground terminal 122 of the second terminal set 120. In the present embodiment, the first conductive member 141 and the second conductive member 142 are both disposed in the insulation housing 150. Specifically, the insulating housing 150 includes two containing slots 153 and 154. The first conductive member 141 and the second conductive member 142 are disposed in the containing slots 153 and 154 respectively to be positioned in the insulating housing 150. In some embodiments, the first conductive member 141/the second conductive member 142 and the insulating housing 150 are combined by assembling.

As shown in FIGS. 2 and 3, in some embodiments, the electrical connector structure 100 further includes a terminal spacer 160. The terminal spacer 160 is disposed in the insulating housing 150 and is located between the first terminal set 110 and the second terminal set 120. The terminal spacer 160 has a plurality of recesses 161 configured to receive the signal terminals 111 and the ground terminal 112 of the first terminal set 110. In some embodiments, the third terminal set 130 faces the second terminal set 120, and the terminal spacer 160 further has a plurality of recesses 162 configured to receive the terminals of the third terminal set 130. In some embodiments, the insulating housing 150 and the terminal spacer 160 are combined by assembling.

Figure 4:
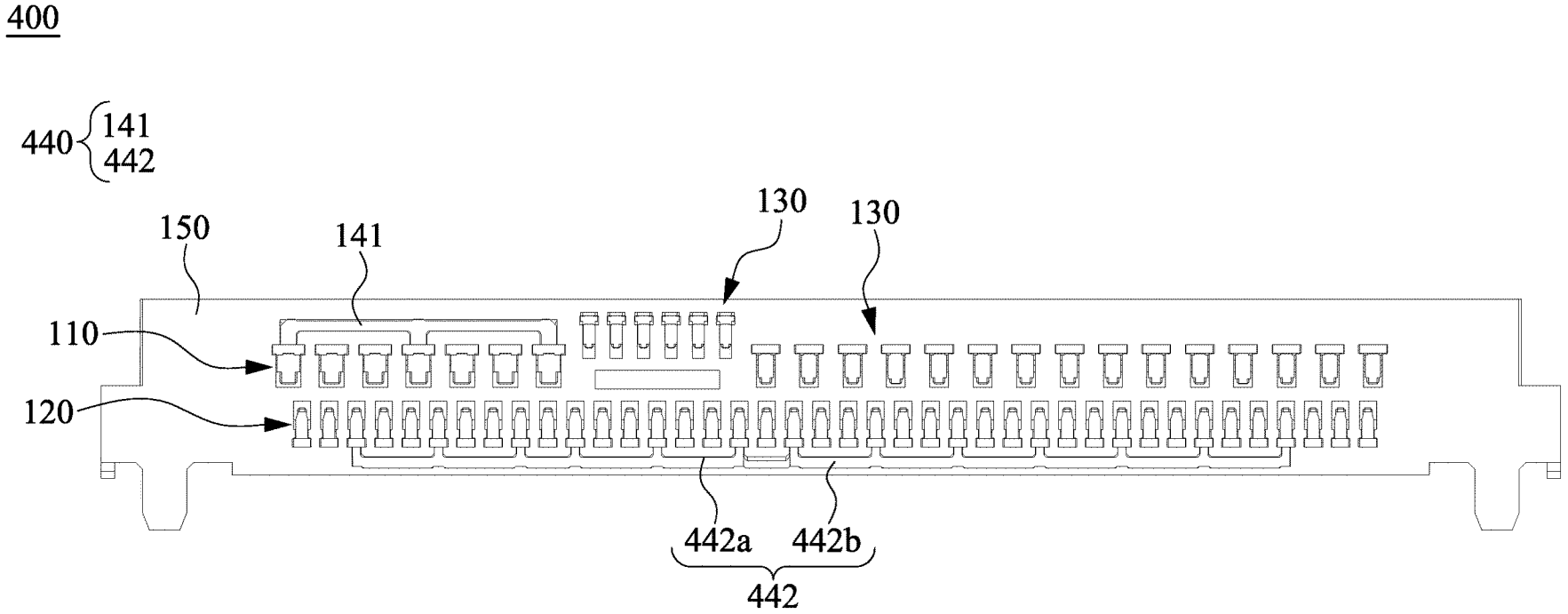
FIG. 4 illustrates a cross sectional view of an electrical connector structure in accordance with another embodiment of the present disclosure.

Reference is made to FIG. 4, which illustrates a cross sectional view of an electrical connector structure 400 in accordance with another embodiment of the present disclosure. The present embodiment differs from the embodiment shown in FIGS. 2 and 3 in that the second conductive member 442 of the conductive member 440 includes a plurality of conductive components 442*a* and 442*b*. The conductive components 442*a* and 442*b* are arranged on a side of the second terminal set 120 away from the first terminal set 110. Each of the conductive components 442*a* and 442*b* is electrically connected to at least one of the ground terminals 122 of the second terminal set 120. The present disclosure is not limited to two conductive components as exemplified. The second conductive member 142 may include three or more conductive components.

As shown in FIG. 4, in some embodiments, two immediately adjacent conductive components are physically separated and electrically connected. In some embodiments, two immediately adjacent conductive components may keep a gap therebetween (i.e., two immediately adjacent conductive components are separated by air). Alternatively, two immediately adjacent conductive components may be separated by the insulating material of the insulating housing 150. In the present embodiment, the conductive components 442*a* and 442*b* and the ground terminals 122 of the second terminal set 120 are in a one-to-many correspondence. In other words, each of the conductive components 442*a* and 442*b* may be electrically connected with multiple ground terminals 122. In some embodiments, the conductive components and the ground terminals 122 of the second terminal set 120 are in a one-to-one correspondence. In other words, each conductive component is electrically connected to exactly one ground terminal 122, and each ground terminal 122 is electrically connected to exactly one conductive component.

Figure 5:
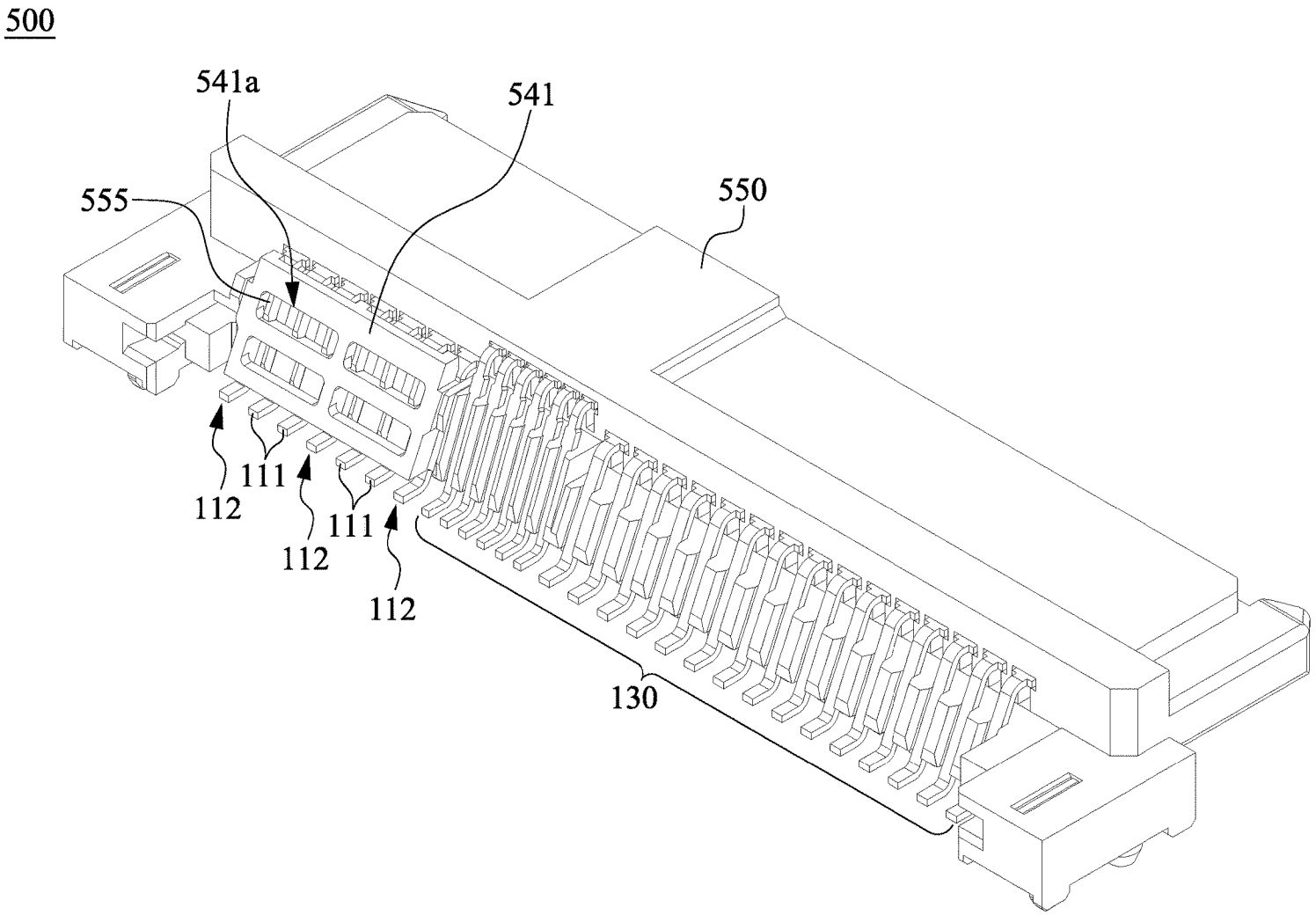
FIG. 5 illustrates an assembled view of an electrical connector structure in accordance with another embodiment of the present disclosure.

Reference is made to FIG. 5, which illustrates an assembled view of an electrical connector structure 500 in accordance with another embodiment of the present disclosure. The present embodiment differs from the embodiment shown in FIGS. 2 and 3 in that the insulating housing 550 has a plurality of protruding structures 555, and the first conductive member 541 is disposed on the protruding structures 555. Specifically, the protruding structures 555 extend outwardly from the spaces between the signal terminals 111/the ground terminal 112 of the first terminal set 110. The first conductive member 541 has at least one opening portion 541*a* that engages the protruding structures 555 to position the first conductive member 541 on the insulating housing 550.

Figure 6:
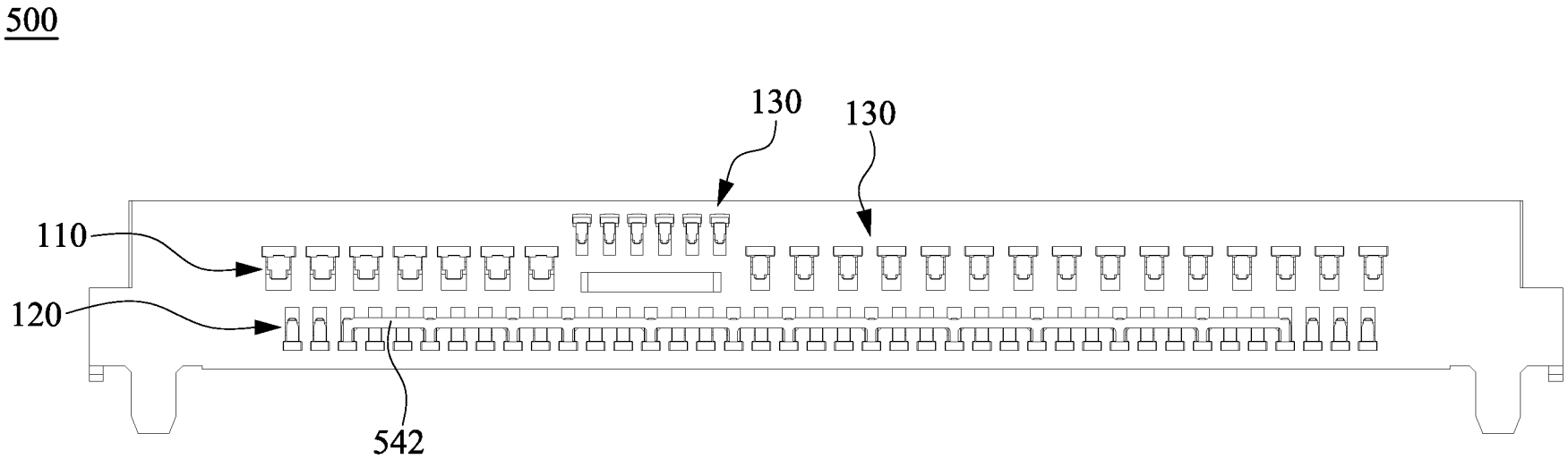
FIG. 6 illustrates a cross sectional view of the electrical connector structure shown in FIG. 5.

Reference is made to FIG. 6, which illustrates a cross sectional view of the electrical connector structure 500 shown in FIG. 5. The present embodiment further differs from the embodiment shown in FIGS. 2 and 3 in that the second conductive member 542 is disposed in the insulating housing 550 and is located between the first terminal set 110 and the second terminal set 120. It should be noted that the second conductive member 542 is not limited to the arrangement described above. In some embodiments, the second conductive member 542 may alternatively be disposed on a side of the second terminal set 120 away from the first terminal set 110.

Figure 7:
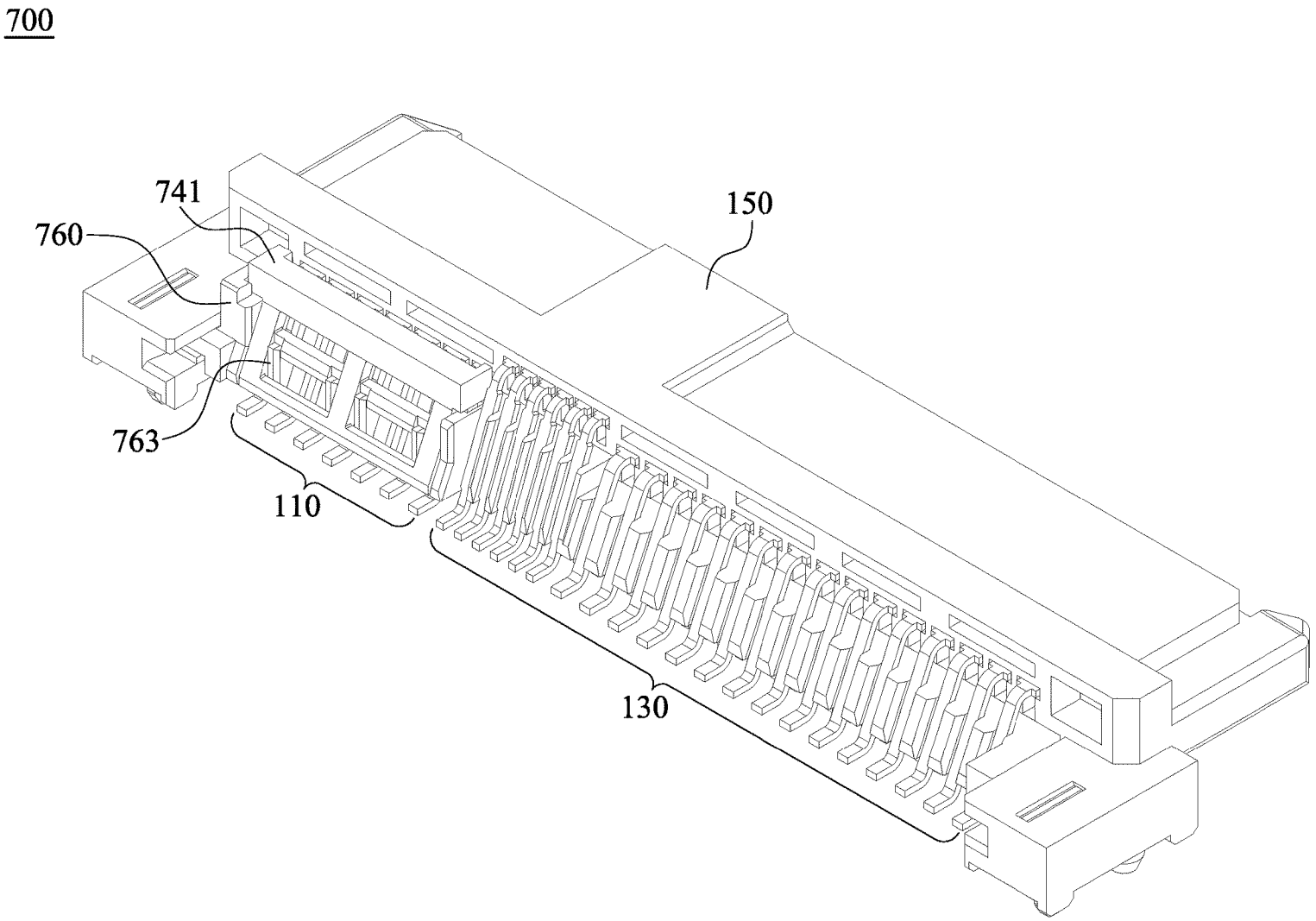
FIG. 7 illustrates an assembled view of an electrical connector structure in accordance with another embodiment of the present disclosure.

Reference is made to FIG. 7, which illustrates an assembled view of an electrical connector structure 700 in accordance with another embodiment of the present disclosure. The present embodiment differs from the embodiment shown in FIGS. 5 and 6 in that the first conductive member 741 is disposed on the terminal spacer 760 and partially covers a side of the first terminal set 110 away from the terminal spacer 760. In some embodiments, the terminal spacer 760 has a plurality of protruding structures 763. The protruding structures 763 extend outwardly from the sidewalls of the recesses for receiving the first terminal set 110 and are configured to support the first conductive member 741 to position the first conductive member 741 on the terminal spacer 760.

Figure 8:
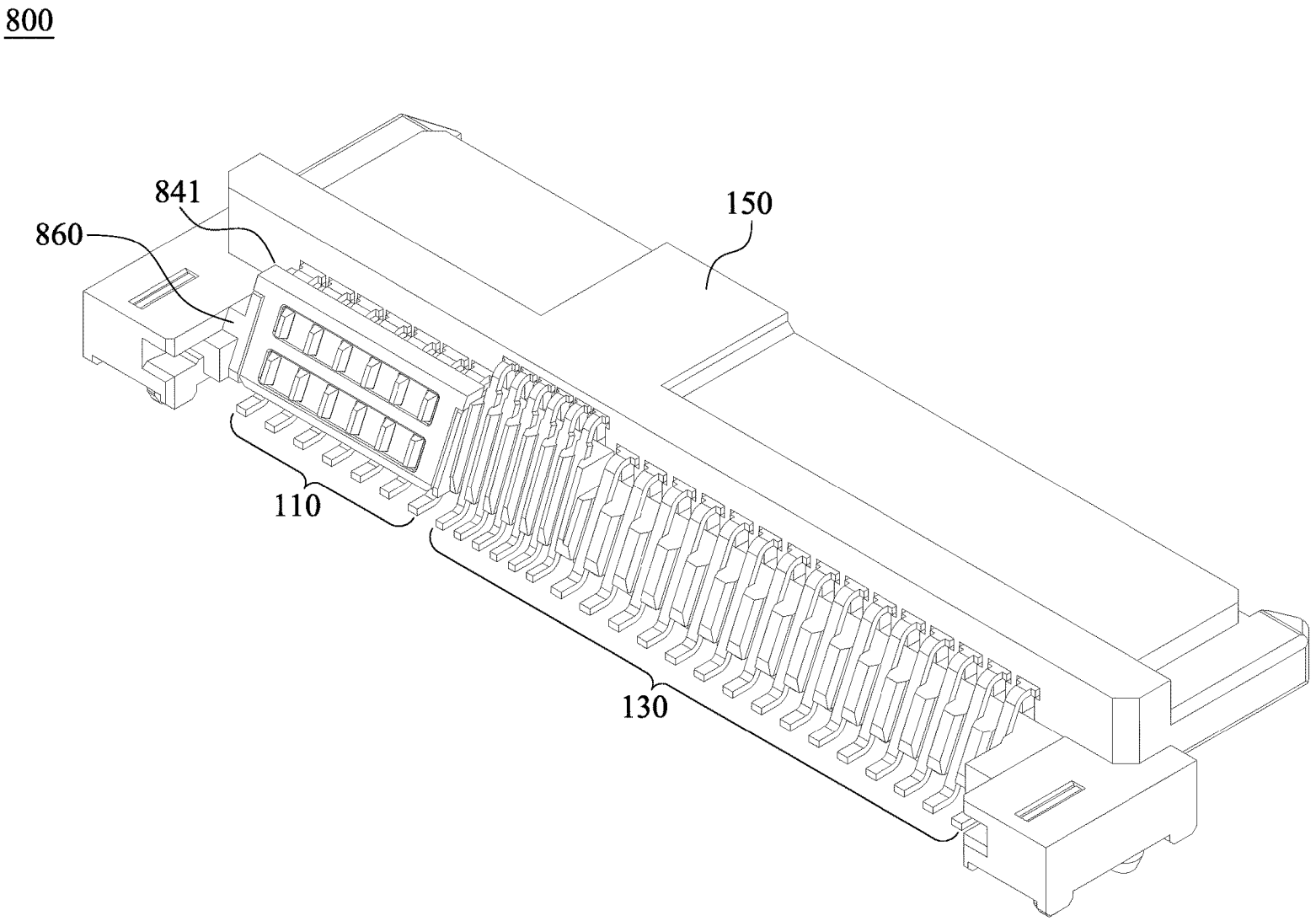
FIG. 8 illustrates an assembled view of an electrical connector structure in accordance with another embodiment of the present disclosure.

Reference is made to FIG. 8, which illustrates an assembled view of an electrical connector structure 800 in accordance with another embodiment of the present disclosure. The present embodiment differs from the embodiment shown in FIG. 7 in that the first conductive member 841 is fused to the terminal spacer 860. In some embodiments, manufacturing the electrical connector structure 800 includes installing the first conductive member 841 on the terminal spacer 860, followed by melting the terminal spacer 860 to fuse the first conductive member 841 to the terminal spacer 860.

Figure 9:
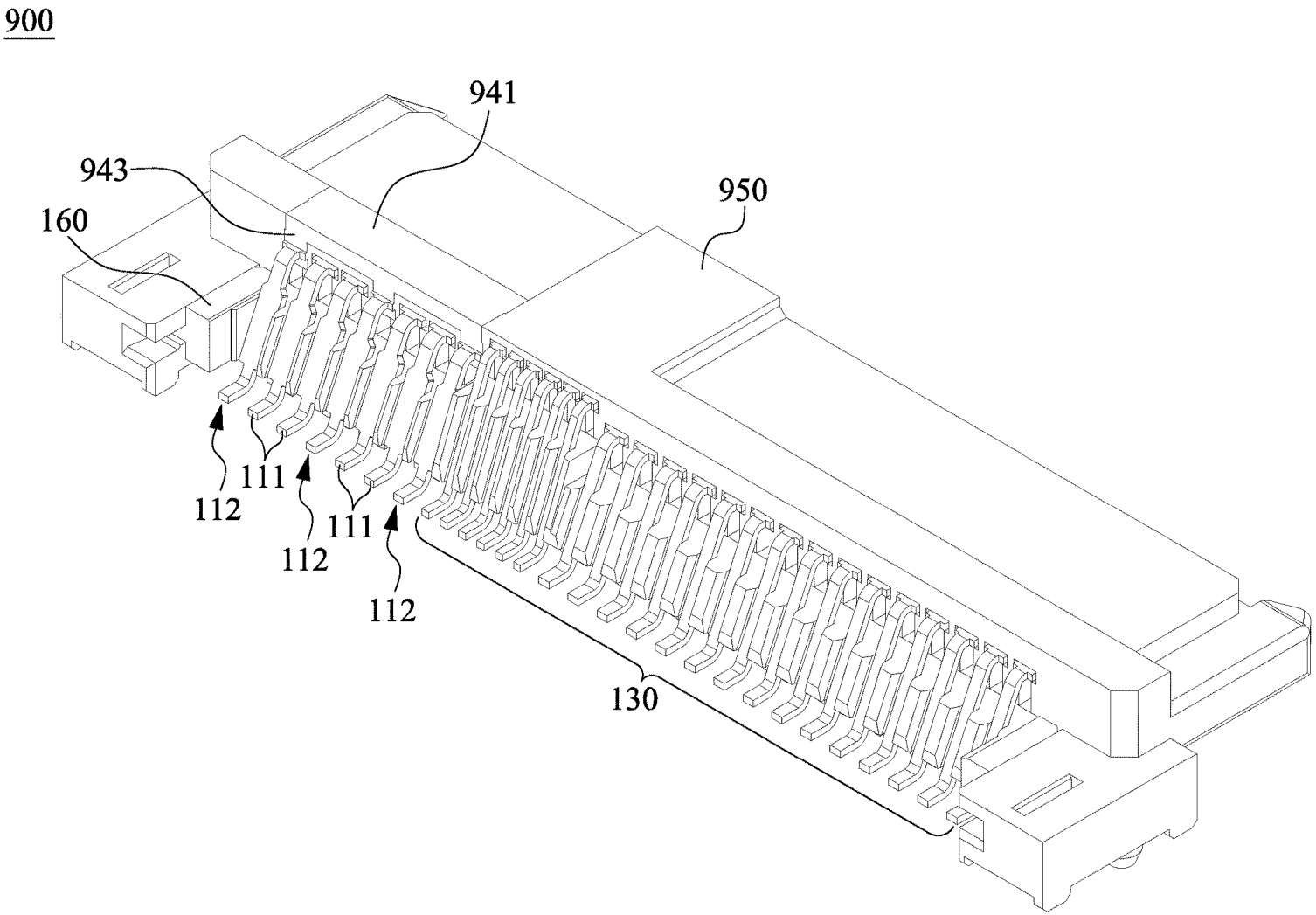
FIG. 9 illustrates an assembled view of an electrical connector structure in accordance with another embodiment of the present disclosure.

Reference is made to FIG. 9, which illustrates an assembled view of an electrical connector structure 900 in accordance with another embodiment of the present disclosure. The present embodiment differs from the embodiment shown in FIGS. 2 and 3 in that the first conductive member 941 is disposed on the insulating housing 950, and the first conductive member 941 wraps around and contacts a section of the ground terminal 112 of the first terminal set 110 (e.g., a middle section of the ground terminal 112 inside the insulating housing 950). In some embodiments, the first conductive member 941 includes at least one projection 943. The ground terminal 112 of the first terminal set 110 is partially embedded in the projection 943 of the first conductive member 941. In some embodiments, the ground terminal 112 and the first conductive member 941 are combined by insert molding.

Figure 10:
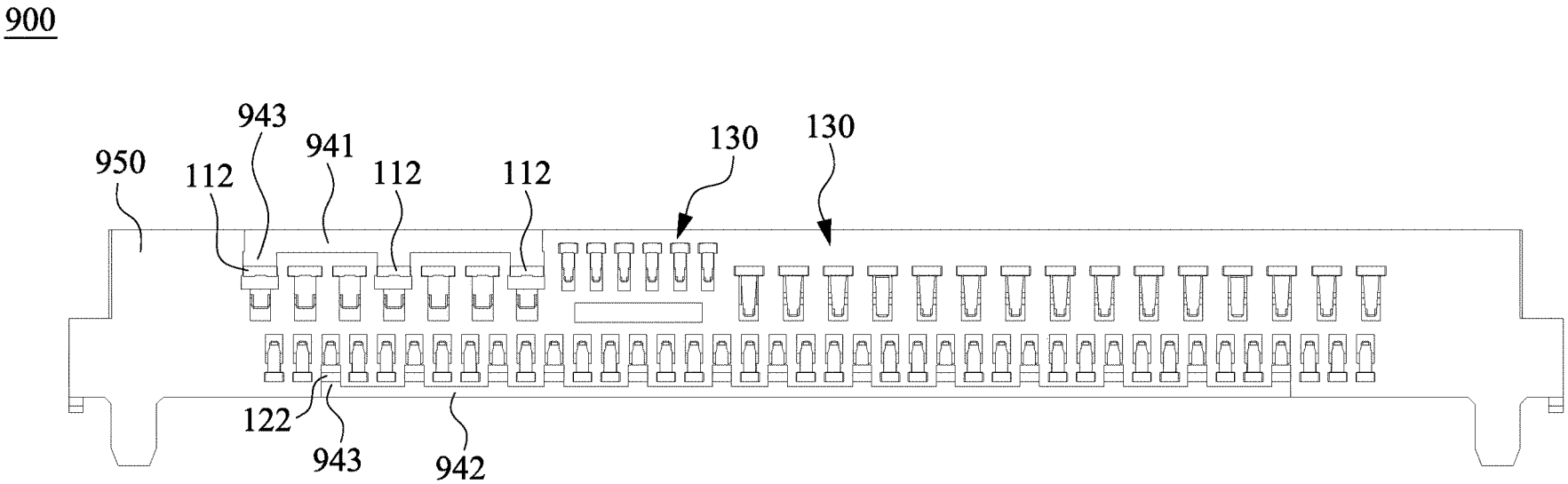
FIG. 10 illustrates a cross sectional view of the electrical connector structure shown in FIG. 9.

Reference is made to FIG. 10, which illustrates a cross sectional view of the electrical connector structure 900 shown in FIG. 9. The present embodiment further differs from the embodiment shown in FIGS. 2 and 3 in that the second conductive member 942 is disposed on the insulating housing 950, and the second conductive member 942 wraps around and contacts a section of the ground terminal 122 of the second terminal set 120 (e.g., a middle section of the ground terminal 122 inside the insulating housing 950). In some embodiments, the second conductive member 942 includes at least one projection 943. The ground terminal 122 of the second terminal set 120 is partially embedded in the projection 943 of the second conductive member 942. In some embodiments, the ground terminal 122 and the second conductive member 942 are combined by insert molding.

Figure 11:
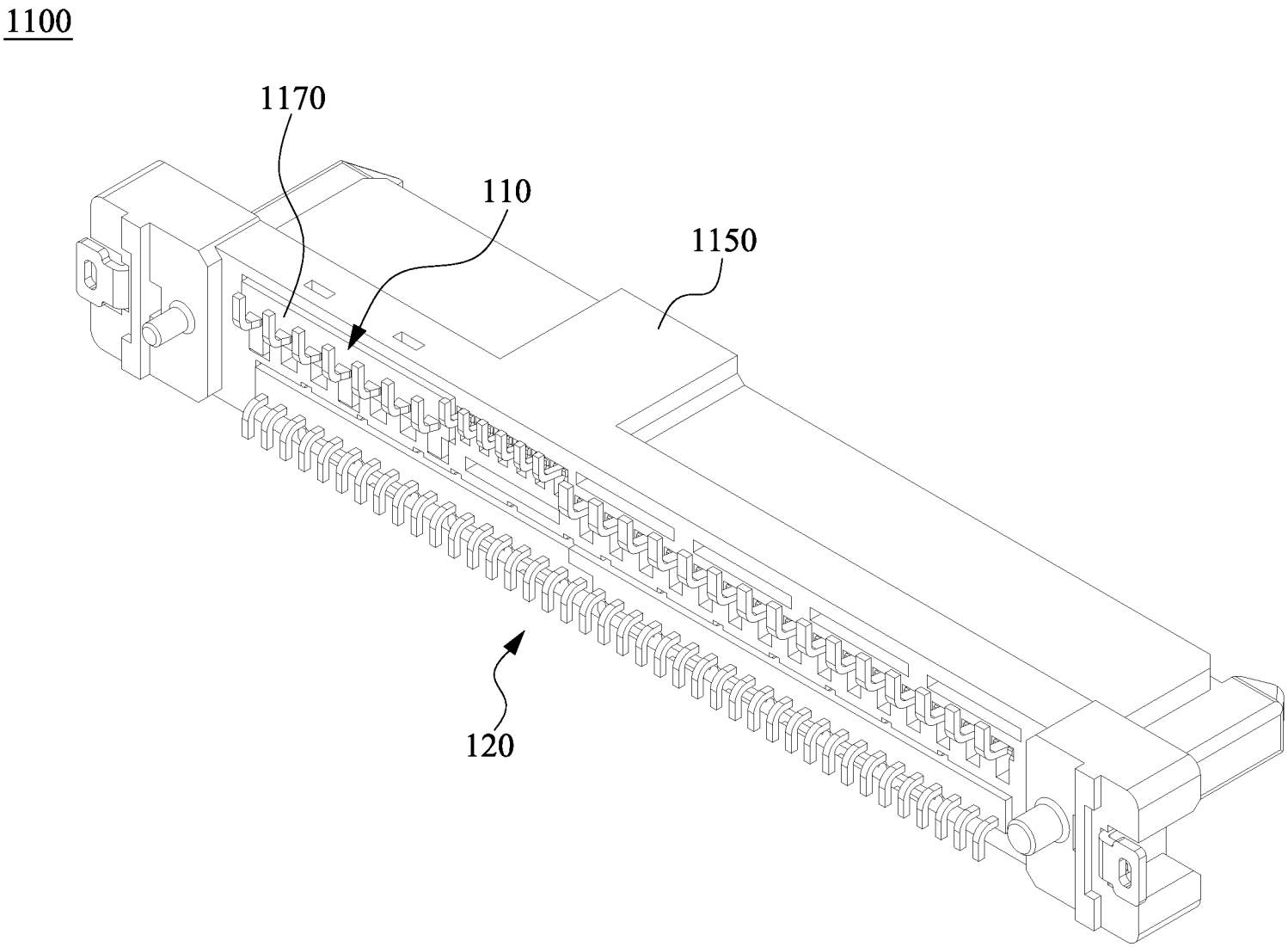
FIG. 11 illustrates an assembled view of an electrical connector structure in accordance with another embodiment of the present disclosure.
Figure 12:
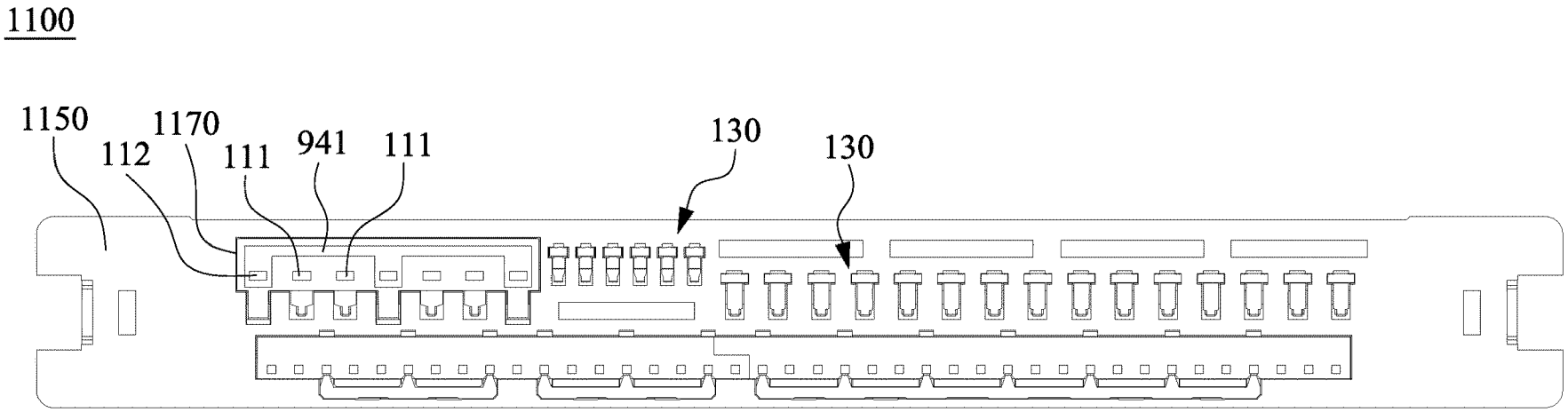
FIG. 12 illustrates a cross sectional view of the electrical connector structure shown in FIG. 11.

Reference is made to FIGS. 11 and 12. FIG. 11 illustrates an assembled view of an electrical connector structure 1100 in accordance with another embodiment of the present disclosure. FIG. 12 illustrates a cross sectional view of the electrical connector structure 1100 shown in FIG. 11. The present embodiment differs from the embodiment shown in FIG. 9 in that the electrical connector structure 1100 further includes an insulating member 1170 disposed in the insulating housing 1150. The insulating member 1170 encapsulates the first conductive member 941 and wraps around a section of each of the signal terminals 111 of the first terminal set 110 (e.g., a middle section of the signal terminal 111 inside the insulating housing 1150). In some embodiments, manufacturing the electrical connector structure 1100 includes combining the ground terminal 112 of the first terminal set 110 and the first conductive member 941 by insert molding, followed by combining the first conductive member 941/the signal terminals 111 and the insulating member 1170 by insert molding.

Figure 13:
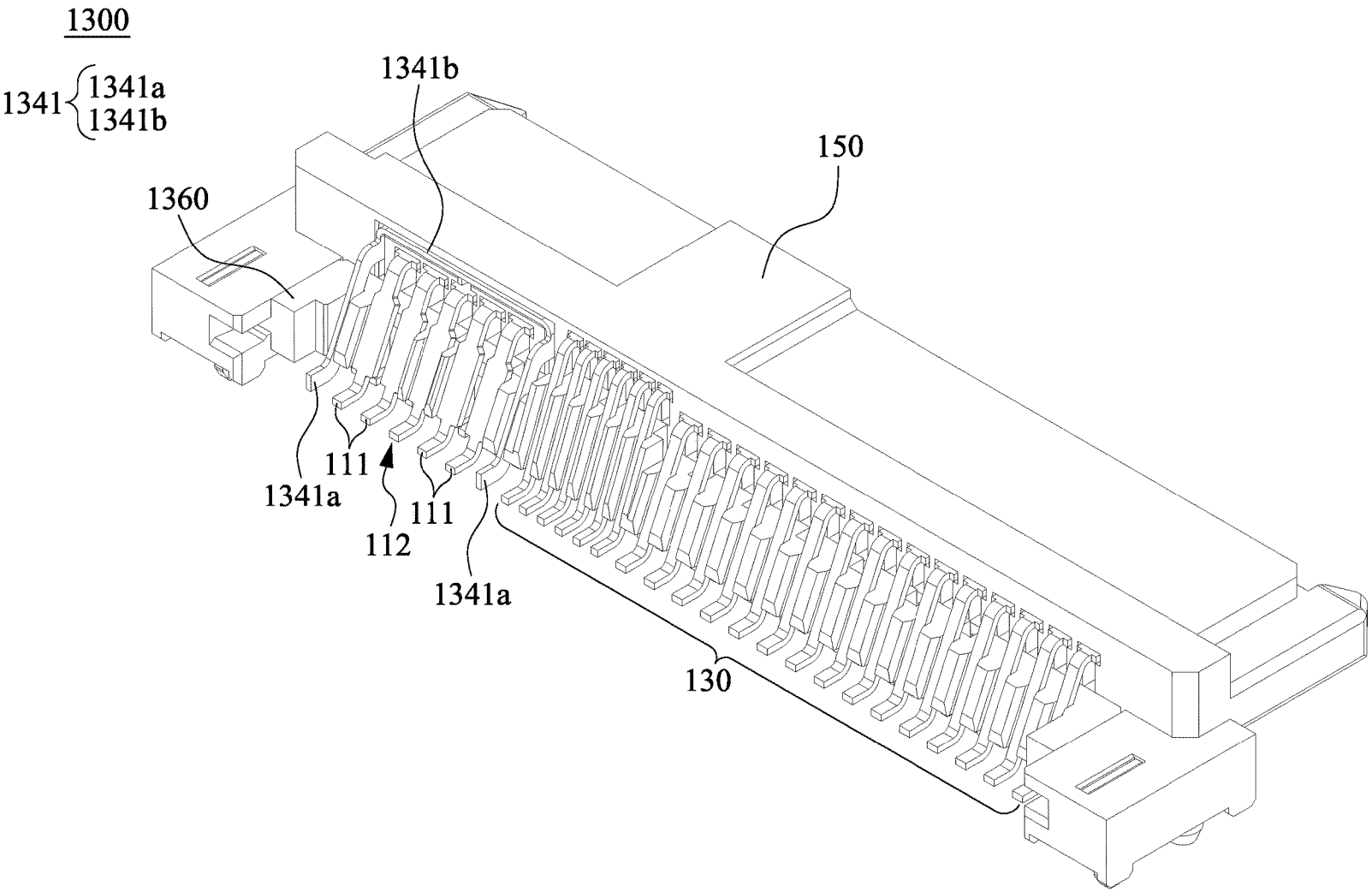
FIG. 13 illustrates an assembled view of an electrical connector structure in accordance with another embodiment of the present disclosure.
Figure 14:
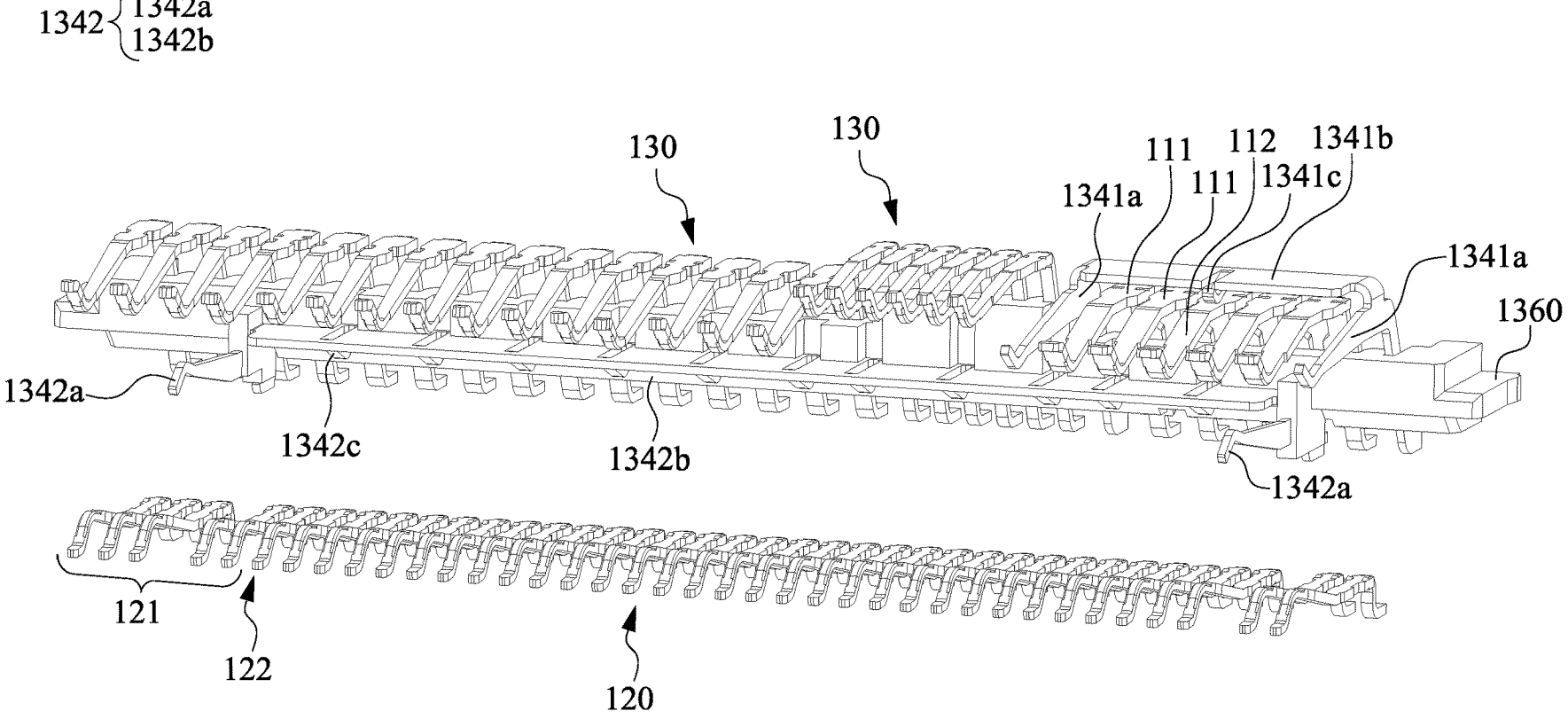
FIG. 14 illustrates an enlarged view of some components of the electrical connector structure shown in FIG. 13.

Reference is made to FIGS. 13 and 14. FIG. 13 illustrates an assembled view of an electrical connector structure 1300 in accordance with another embodiment of the present disclosure. FIG. 14 illustrates an enlarged view of some components of the electrical connector structure 1300 shown in FIG. 13. The present embodiment differs from the embodiment shown in FIGS. 2 and 3 in that the first conductive member 1341 includes at least one conductive terminal 1341*a* and a conductive connecting structure 1341*b*. The conductive terminal 1341*a* is disposed between or on a side of the signal terminals 111 of the first terminal set 110 to serve as ground terminal of the first terminal set 110. The conductive connecting structure 1341*b* physically connects the conductive terminal 1341*a* and is electrically connected to the ground terminal 112 of the first terminal set 110. In some embodiments, the first conductive member 1341 is a metallic member.

As shown in FIGS. 13 and 14, in the present embodiment, the first conductive member 1341 includes two conductive terminals 1341*a* disposed on opposite sides of the first terminal set 110. The two conductive terminals 1341*a* may replace the leftmost and the rightmost ground terminals 112 of the first terminal set 110 in the embodiment shown in FIGS. 2 and 3. The conductive connecting structure 1341*b* is interconnected between the two conductive terminals 1341*a* and is electrically connected to the ground terminal 112 at the center of the first terminal set 110. As shown in FIG. 14, in some embodiments, the conductive connecting structure 1341*b* has a projection 1341*c*. The projection 1341*c* extends toward the ground terminal 112 at the center of the first terminal set 110 and is electrically connected thereto.

As shown in FIG. 14, in some embodiments, the second conductive member 1342 is structurally similar to the first conductive member 1341. Specifically, the second conductive member 1342 is disposed on a side of the terminal spacer 1360 away from the first terminal set 110 and includes at least one conductive terminal 1342*a* and a conductive connecting structure 1342*b*. The conductive terminal 1342*a* is disposed between or on a side of the signal terminals 121 of the second terminal set 120 to serve as ground terminal of the second terminal set 120. The conductive connecting structure 1342*b* physically connects the conductive terminal 1342*a* and is electrically connected to the ground terminal 122 of the second terminal set 120. In some embodiments, the second conductive member 1342 is a metallic member.

As shown in FIG. 14, in the present embodiment, the second conductive member 1342 includes two conductive terminals 1342*a* which may replace the leftmost and the rightmost ground terminals 122 of the second terminal set 120 in the embodiment shown in FIG. 3. The conductive connecting structure 1342*b* is interconnected between the two conductive terminals 1342*a* and is electrically connected to the ground terminals 122 of the second terminal set 120. In some embodiments, the conductive connecting structure 1342*b* has a plurality of projections 1342*c*. Each of the projections 1342*c* extends toward a corresponding ground terminal 122 of the second terminal set 120 and is electrically connected thereto.

It should be noted that the first conductive member 1341/the second conductive member 1342 is not limited to including two conductive terminals 1341*a*/1342*a*. Depending on the application requirements, the first conductive member 1341 may alternatively include a single conductive terminal 1341*a* on one side, or include one or more additional conductive terminals between the two conductive terminals 1341*a* shown in FIGS. 13 and 14 to serve as ground terminal(s) of the first terminal set 110. Similarly, the second conductive member 1342 may alternatively include a single conductive terminal 1342*a* on one side, or include one or more additional conductive terminals between the two conductive terminals 1342*a* shown in FIG. 14 to serve as ground terminal(s) of the second terminal set 120.

Figure 15:
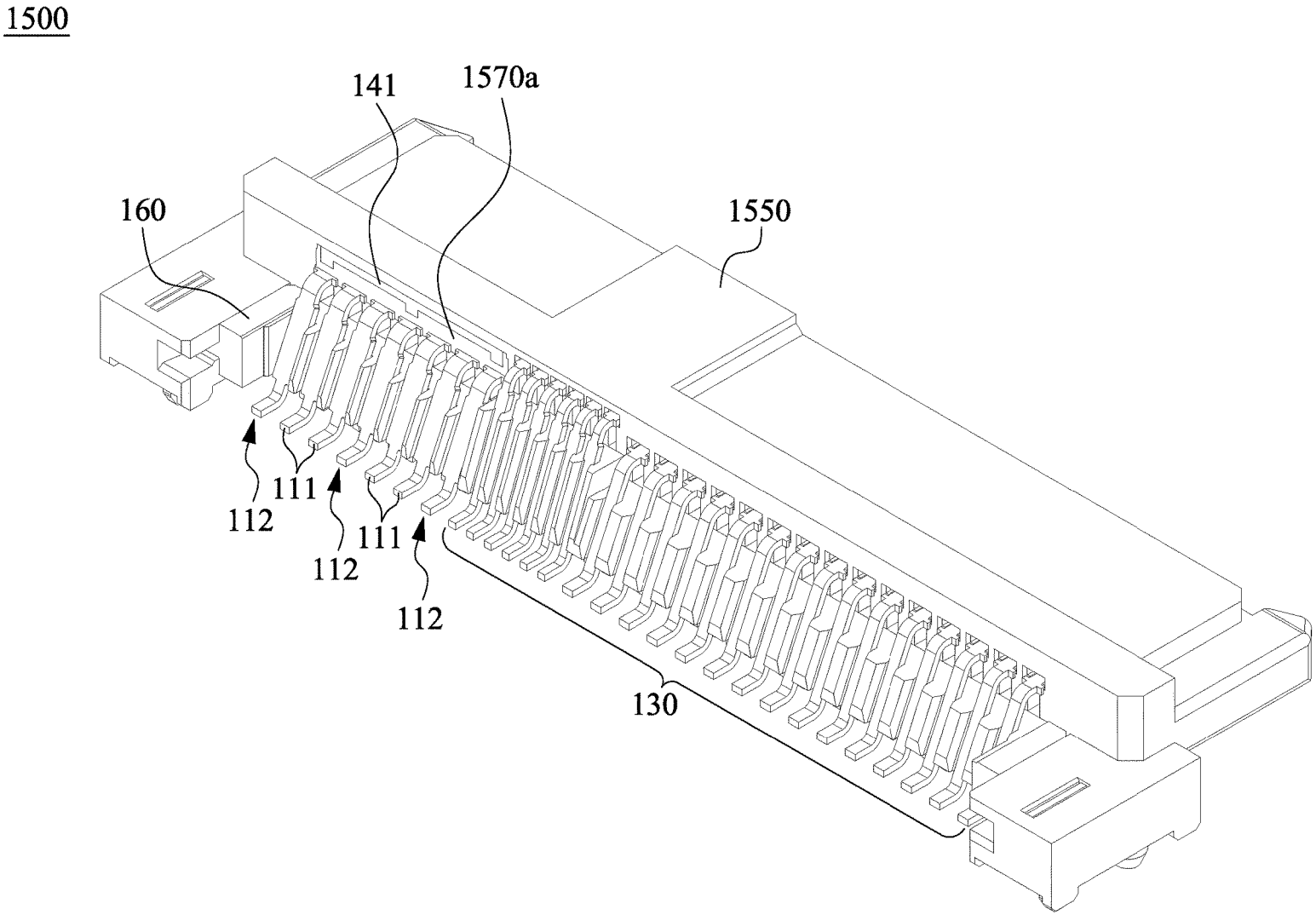
FIG. 15 illustrates an assembled view of an electrical connector structure in accordance with another embodiment of the present disclosure.

Reference is made to FIG. 15, which illustrates an assembled view of an electrical connector structure 1500 in accordance with another embodiment of the present disclosure. The present embodiment differs from the embodiment shown in FIGS. 2 and 3 in that the electrical connector structure 1500 further includes an insulating member 1570*a*. The insulating member 1570*a* is disposed in the insulating housing 1550 and wraps around a section each of the signal terminals 111 (e.g., a middle section of the signal terminal 111 inside the insulating housing 1550) and a section of the ground terminal 112 (e.g., a middle section of the ground terminal 112 inside the insulating housing 1550). The first conductive member 141 is electrically connected to the ground terminal 112 of the first terminal set 110 via the insulating member 1570*a* interposed therebetween. In some embodiments, the first terminal set 110 and the insulating member 1570*a* are combined by insert molding. In some embodiments, the first conductive member 141 is disposed inside the insulating member 1570*a* (e.g., by assembling, molding or insertion).

Figure 16:
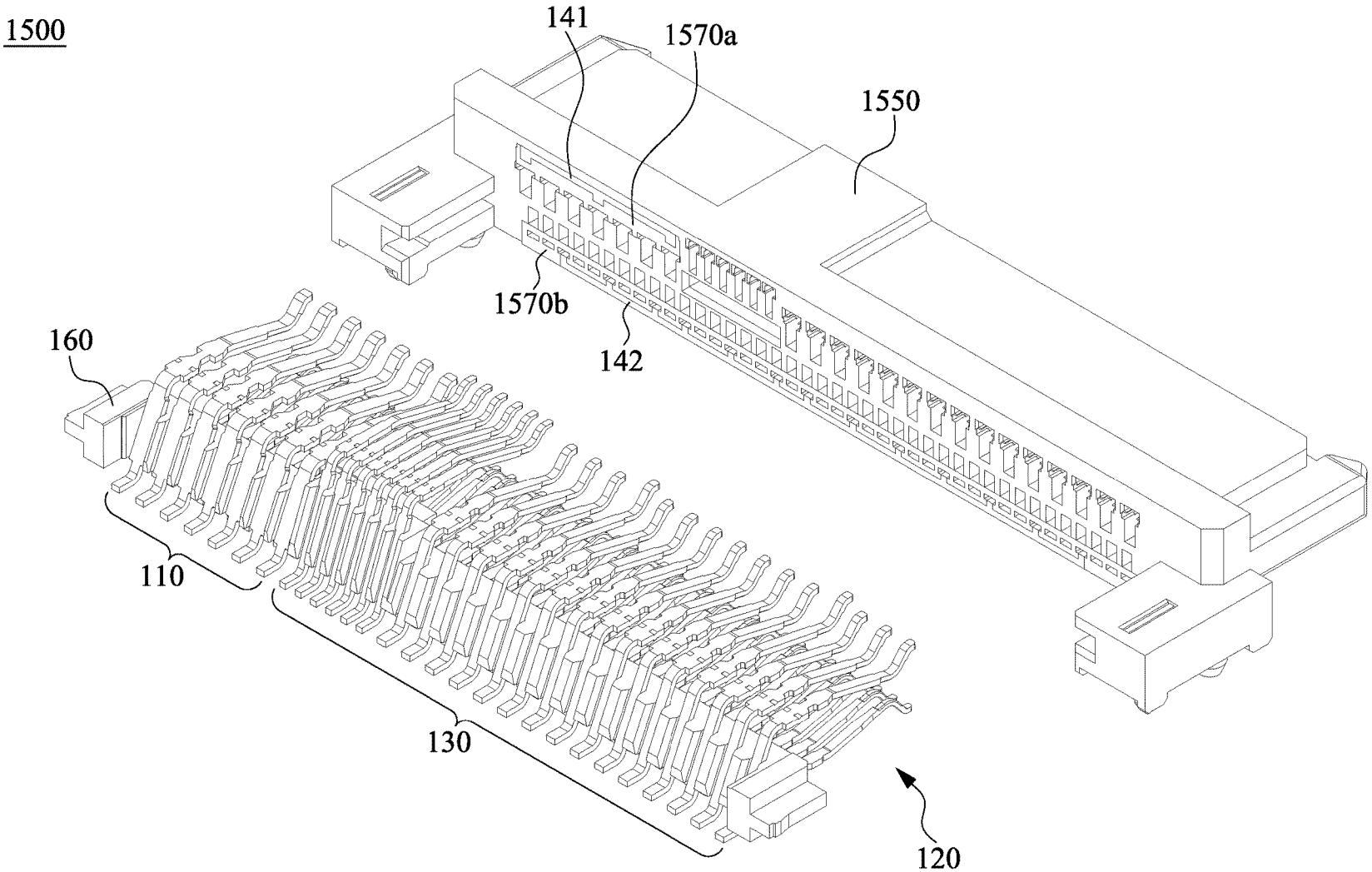
FIG. 16 illustrates an exploded view of the electrical connector structure shown in FIG. 15.

Reference is made to FIG. 16, which illustrates an exploded view of the electrical connector structure 1500 shown in FIG. 15. In some embodiments, the electrical connector structure 1500 further includes an insulating member 1570*b*. The structural configuration of the insulating member 1570*b*, the second terminal set 120 and the second conductive member 142 collectively is similar to that of the insulating member 1570*a*, the first terminal set 110 and the first conductive member 141 collectively.

As shown in FIG. 16, specifically, the insulating member 1570*b* is disposed in the insulating housing 1550 and wraps around a section each of the signal terminals 121 (e.g., a middle section of the signal terminal 121 inside the insulating housing 1550) and a section of the ground terminal 122 (e.g., a middle section of the ground terminal 122 inside the insulating housing 1550). The second conductive member 142 is electrically connected to the ground terminal 122 of the second terminal set 120 via the insulating member 1570*b* interposed therebetween. In some embodiments, the second terminal set 120 and the insulating member 1570*b* are combined by insert molding. In some embodiments, the second conductive member 142 is disposed inside the insulating member 1570*b* (e.g., by assembling, molding or insertion).

Figure 17:
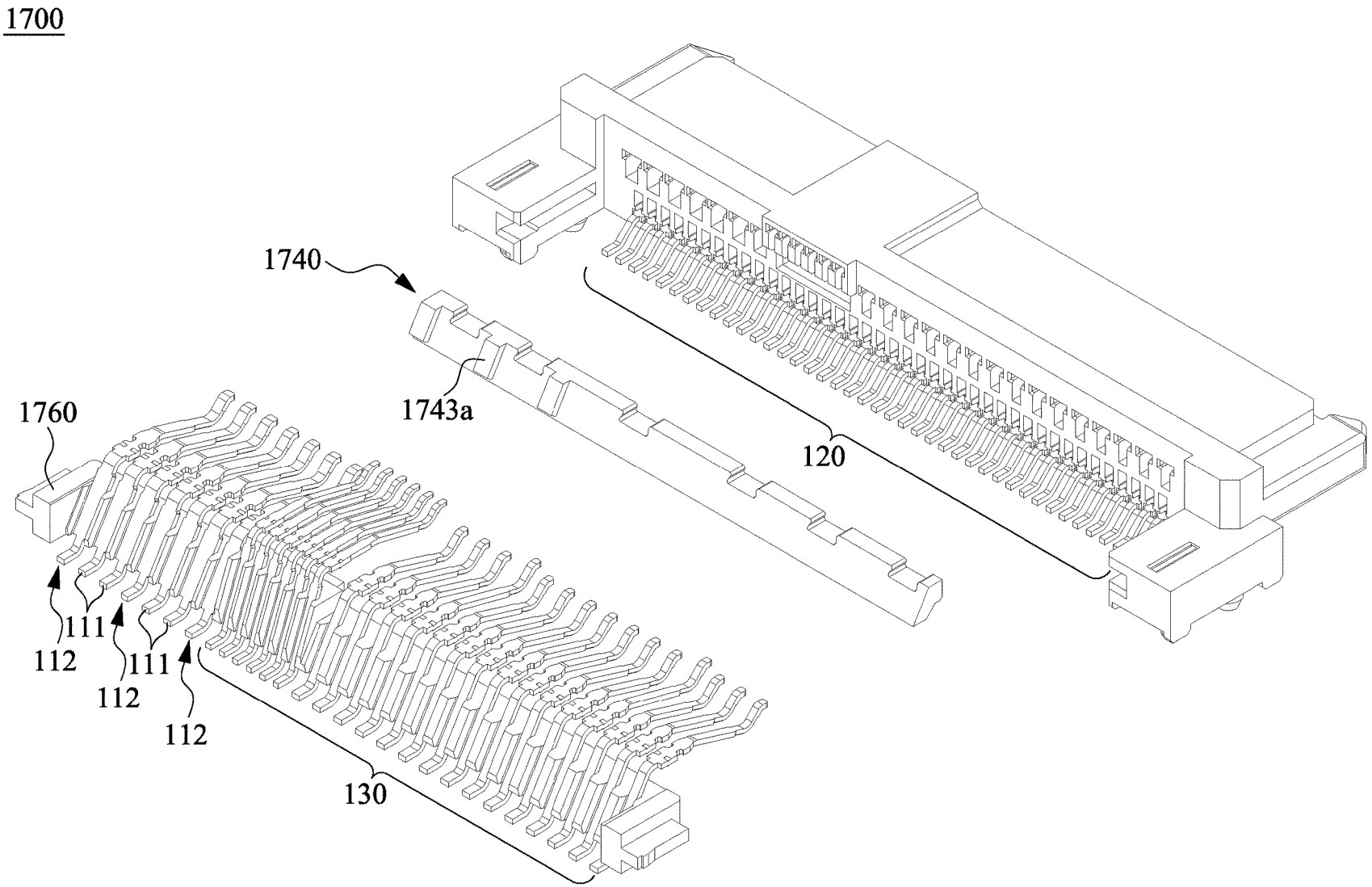
FIG. 17 illustrates an exploded view of an electrical connector structure in accordance with another embodiment of the present disclosure.
Figure 18:
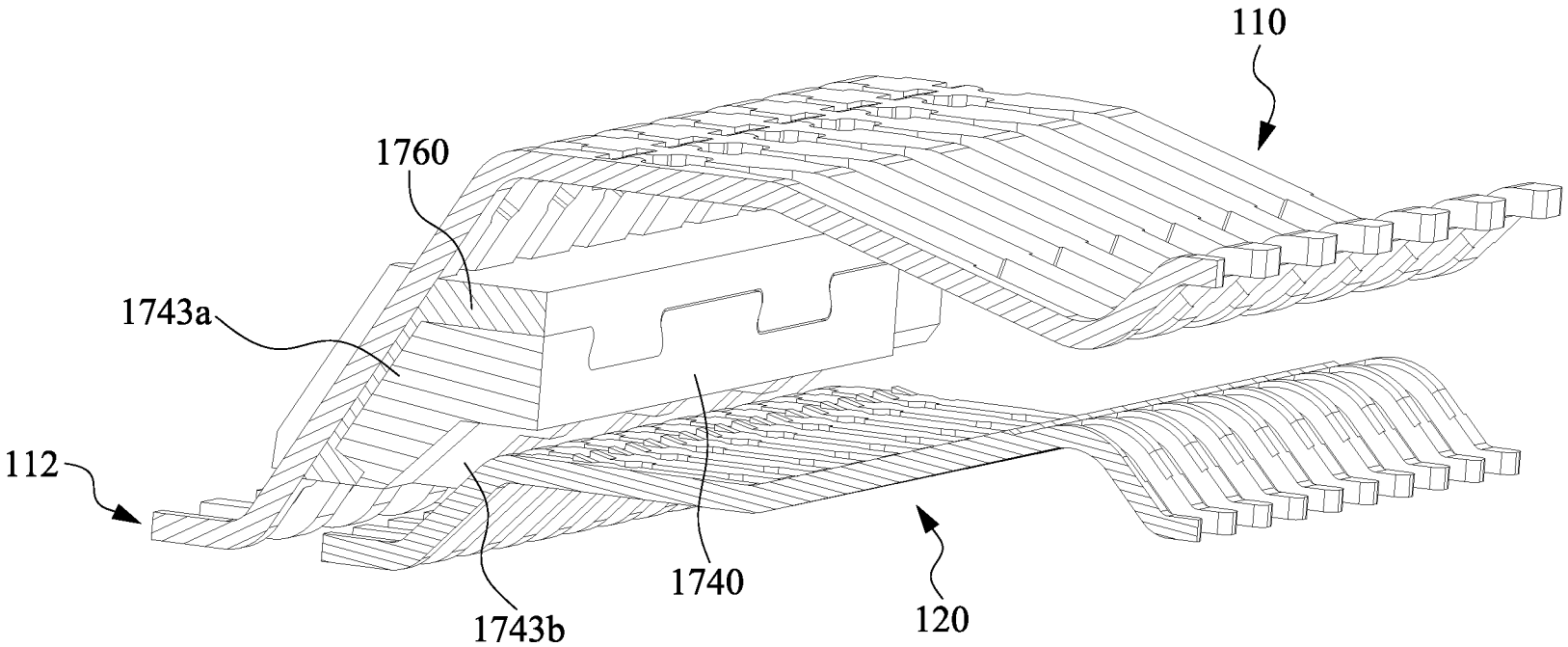
FIG. 18 illustrates a cross sectional view of some components of the electrical connector structure shown in FIG. 17.

Reference is made to FIGS. 17 and 18. FIG. 17 illustrates an exploded view of an electrical connector structure 1700 in accordance with another embodiment of the present disclosure. FIG. 18 illustrates a cross sectional view of some components of the electrical connector structure 1700 shown in FIG. 17. The present embodiment differs from the embodiment shown in FIGS. 2 and 3 in that the electrical connector structure 1700 includes a single conductive member 1740 which is electrically connected to both the ground terminal 112 of the first terminal set 110 and the ground terminal 122 of the second terminal set 120. The conductive member 1740 is located between the first terminal set 110 and the second terminal set 120 and is disposed on an inner side of the terminal spacer 1760 (i.e., the side of the terminal spacer 1760 facing the second terminal set 120). The conductive member 1740 is electrically connected to the ground terminal 112 of the first terminal set 110 via the terminal spacer 1760 (which includes insulating material) interposed therebetween. The conductive member 1740 may establish electrical connection with the ground terminal 122 of the second terminal set 120 with or without physically contacting the ground terminal 122. In some embodiments, the conductive member 1740 has at least one projection 1743*a* on a side facing the first terminal set 110. The projection 1743*a* extends toward the corresponding ground terminal 112 and is electrically connected thereto. The conductive member 1740 has at least one projection 1743*b* on a side facing the second terminal set 120. The projection 1743*b* extends toward the corresponding ground terminal 122 and is electrically connected thereto.

Figure 19:
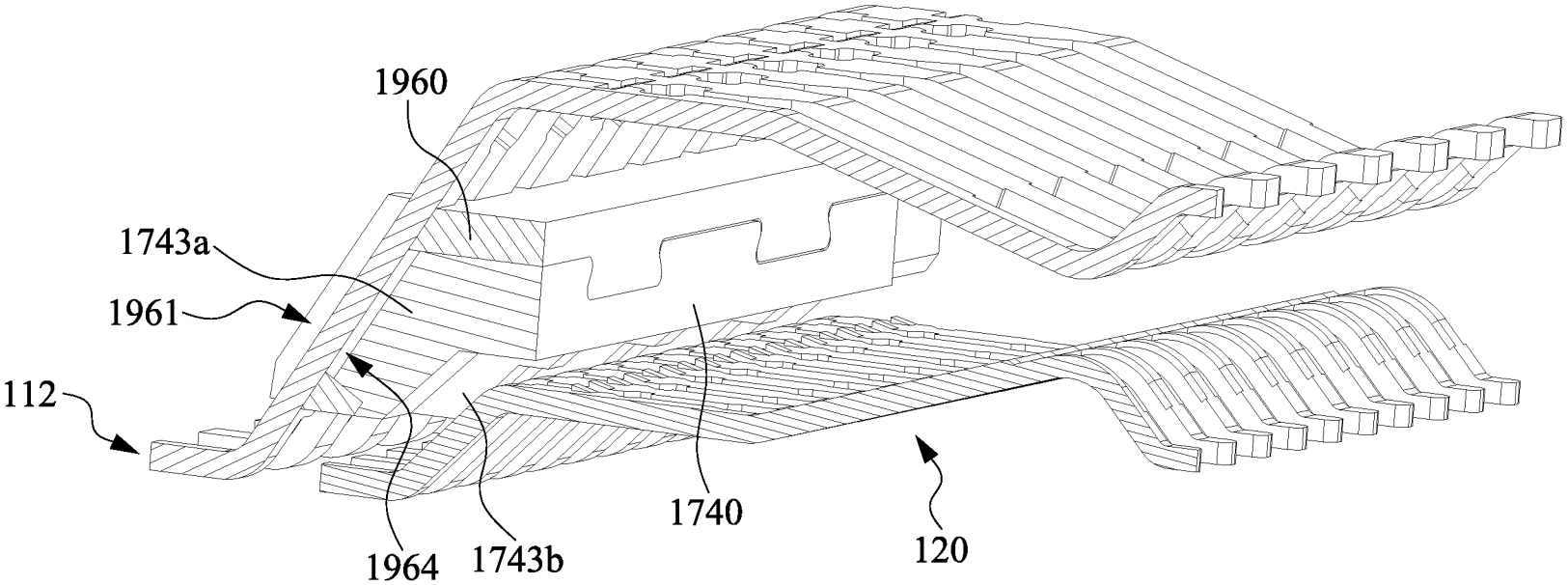
FIG. 19 illustrates a cross sectional view of some components of an electrical connector structure in accordance with another embodiment of the present disclosure.

Reference is made to FIG. 19, which illustrates a cross sectional view of some components of an electrical connector structure in accordance with another embodiment of the present disclosure. The present embodiment differs from the embodiment shown in FIG. 18 in that one or more of the recesses 1961 of the terminal spacer 1960 for receiving the ground terminal 112 has an opening 1964, and the conductive member 1740 is electrically connected to the ground terminal 112 of the first terminal set 110 via the opening 1964 interposed therebetween. In other words, in the present embodiment, the conductive member 1740 is electrically connected to the ground terminal 112 via air. In some embodiments, the conductive member 1740 and the ground terminal 112 are separated by a gap substantially ranging from 0.01 mm to 0.3 mm.

In sum, the electrical connector structure of the present disclosure is equipped with at least one conductive member that is electrically connected to the first and the second terminal sets, and not electrically connected to the third terminal set. By this arrangement, crosstalk may be effectively reduced.

Although the present disclosure has been described by way of the exemplary embodiments above, the present disclosure is not to be limited to those embodiments. Any person skilled in the art can make various changes and modifications without departing from the spirit and the scope of the present disclosure. Therefore, the protective scope of the present disclosure shall be the scope of the claims as attached.

What is claimed is:

1. An electrical connector structure, comprising:

an insulating housing;

a first terminal set disposed in the insulating housing and comprising a plurality of signal terminals and at least one ground terminal;

a second terminal set disposed in the insulating housing and comprising a plurality of signal terminals and at least one ground terminal;

a third terminal set disposed in the insulating housing;

at least one conductive member electrically connected to the at least one ground terminal of the first terminal set and the at least one ground terminal of the second terminal set, and not electrically connected to the third terminal set; and an insulating member disposed in the insulating housing, the insulating member wrapping around a section of the at least one ground terminal of the first terminal set and a section of each of the signal terminals of the first terminal set, wherein the at least one conductive member is electrically connected to the at least one ground terminal of the first terminal set via the insulating member.

2. The electrical connector structure of claim 1, wherein the at least one conductive member comprises a first conductive member and a second conductive member, the first conductive member is electrically connected to the at least one ground terminal of the first terminal set, and the second conductive member is electrically connected to the at least one ground terminal of the second terminal set.

3. The electrical connector structure of claim 2, wherein the first conductive member and the second conductive member are disposed in or disposed on the insulating housing.

4. The electrical connector structure of claim 3, wherein the insulating housing comprises a plurality of containing slots, the first conductive member and the second conductive member are disposed in the containing slots.

5. The electrical connector structure of claim 3, wherein the insulating housing has a plurality of protruding structures, and the first conductive member is disposed on the protruding structures.

6. The electrical connector structure of claim 2, wherein the at least one ground terminal of the second terminal set is plural in number, the second conductive member comprises a plurality of conductive components, and each of the conductive components is electrically connected to at least one of the ground terminals of the second terminal set.

7. The electrical connector structure of claim 1, wherein the at least one conductive member has a projection extending towards the at least one ground terminal of the first terminal set or the at least one ground terminal of the second terminal set.

8. The electrical connector structure of claim 7, wherein the projection is spaced apart from the at least one ground terminal by 0.01 mm to 0.3 mm.

9. The electrical connector structure of claim 1, wherein the at least one conductive member comprises a conductive plastic member.

10. The electrical connector structure of claim 1, wherein the insulating housing has a socket, the socket is configured to receive a pairing connector having a tongue.

11. The electrical connector structure of claim 1, wherein the electrical connector structure is arranged to be substantially parallel to an external board, the first terminal set is located farther away from the external board than the second terminal set, and a tip of the at least one ground terminal of the first terminal set and tips of the signal terminals of the first terminal set are configured to be connected to the external board.

12. An electrical connector structure, comprising:

an insulating housing;

a first terminal set disposed in the insulating housing and comprising a plurality of signal terminals and at least one ground terminal;

a second terminal set disposed in the insulating housing and comprising a plurality of signal terminals and at least one ground terminal;

a third terminal set disposed in the insulating housing; and at least one conductive member electrically connected to the at least one ground terminal of the first terminal set and the at least one ground terminal of the second terminal set, and not electrically connected to the third terminal set;

wherein the at least one conductive member comprises a first conductive member, the first conductive member wraps around and contacts a section of the at least one ground terminal of the first terminal set.

13. The electrical connector structure of claim 12, wherein the at least one conductive member further comprises a second conductive member, the second conductive member wraps around and contacts a section of the at least one ground terminal of the second terminal set.

14. The electrical connector structure of claim 12, further comprising:

an insulating member encapsulating the first conductive member and wrapping around a section of each of the signal terminals of the first terminal set.

15. An electrical connector structure, comprising:

an insulating housing;

a first terminal set disposed in the insulating housing and comprising a plurality of signal terminals and at least one ground terminal;

a second terminal set disposed in the insulating housing and comprising a plurality of signal terminals and at least one ground terminal;

a third terminal set disposed in the insulating housing; and at least one conductive member electrically connected to the at least one ground terminal of the first terminal set and the at least one ground terminal of the second terminal set, and not electrically connected to the third terminal set;

wherein the at least one conductive member comprises:

at least one conductive terminal disposed between or on a side of the signal terminals of the first terminal set to serve as ground terminal of the first terminal set; and a conductive connecting structure physically connecting the at least one conductive terminal and electrically connected to the at least one ground terminal of the first terminal set.

16. The electrical connector structure of claim 15, wherein a quantity of the at least one conductive terminal is two, the two conductive terminals are disposed on opposite sides of the first terminal set, and the conductive connecting structure is interconnected between the two conductive terminals.

17. The electrical connector structure of claim 15, wherein the at least one conductive member is a metallic member.

18. An electrical connector structure, comprising:

an insulating housing;

a first terminal set disposed in the insulating housing and comprising a plurality of signal terminals and at least one ground terminal;

a second terminal set disposed in the insulating housing and comprising a plurality of signal terminals and at least one ground terminal;

a third terminal set disposed in the insulating housing;

at least one conductive member electrically connected to the at least one ground terminal of the first terminal set and the at least one ground terminal of the second terminal set, and not electrically connected to the third terminal set; and a terminal spacer disposed in the insulating housing and located between the first terminal set and the second terminal set, the terminal spacer having a plurality of recesses, the recesses being configured to receive the at least one ground terminal and the signal terminals of the first terminal set, wherein the at least one conductive member comprises a first conductive member disposed on the terminal spacer and electrically connected to the at least one ground terminal of the first terminal set.

19. The electrical connector structure of claim 18, wherein the first conductive member is fused to the terminal spacer.

20. The electrical connector structure of claim 18, wherein the at least one conductive member is disposed on a side of the terminal spacer facing the second terminal set, and the at least one conductive member is electrically connected to the at least one ground terminal of the first terminal set via the terminal spacer interposed therebetween.

21. The electrical connector structure of claim 18, wherein the at least one conductive member is disposed on a side of the terminal spacer facing the second terminal set, one or more of the recesses corresponding to the at least one ground terminal of the first terminal set each has an opening, and the at least one conductive member is electrically connected to the at least one ground terminal of the first terminal set via the opening interposed therebetween.

* * * * *